US006016814A

United States Patent [19]

Elliott

[11] Patent Number: 6,016,814

[45] Date of Patent: Jan. 25, 2000

[54] METHOD FOR MANUFACTURING A HAIR PIECE

[76] Inventor: James E. Elliott, 12792 Barret La., Santa Ana, Calif. 92705

[21] Appl. No.: 09/175,525

[22] Filed: Oct. 20, 1998

[51] Int. Cl.[7] ..... A41G 5/00; A41G 3/00

[52] U.S. Cl. ..... 132/201; 132/53; 132/55

[58] Field of Search ..... 132/201, 53, 54, 132/55, 56

[56] References Cited

U.S. PATENT DOCUMENTS

| | | | |
|---|---|---|---|
| D. 272,861 | 2/1984 | Incando | D28/93 |
| 3,596,666 | 8/1971 | Dooley | 132/53 |
| 3,654,935 | 4/1972 | Brown | 132/201 |
| 3,722,517 | 3/1973 | Molinario | 132/201 |
| 3,835,868 | 9/1974 | Heck | 132/201 |
| 3,970,092 | 7/1976 | Nelson | 132/201 |
| 4,176,669 | 12/1979 | Levin | 132/53 |
| 4,202,359 | 5/1980 | Clifton | 132/5 |
| 4,254,783 | 3/1981 | Kim | 132/11 |
| 4,688,584 | 8/1987 | Nilsen | 132/53 |
| 4,788,991 | 12/1988 | Nocera | 132/156 |
| 5,313,963 | 5/1994 | Rennex | 132/54 |
| 5,592,957 | 1/1997 | Gazerro et al. | 132/201 |

*Primary Examiner*—John J. Wilson
*Assistant Examiner*—Trang Doan
*Attorney, Agent, or Firm*—Goldstein & Canino

[57] ABSTRACT

A method for constructing a hair piece using a hair piece manufacturing kit. The hair piece manufacturing kit comprises a mesh base with a plurality of loops, a two-way tape having a top adhesive surface and a bottom adhesive surface, a gluing gel and a hair clip. The method comprises the steps of clipping a plurality of hair strands, gently coating the hair strands with a gluing gel, inserting the hair strands into the loops of the mesh base, and securely attaching the mesh base to the two-way tape.

5 Claims, 4 Drawing Sheets

METHOD FOR MANUFACTURING A HAIR PIECE

BACKGROUND OF THE INVENTION

This invention relates to hairpieces, and more particularly to a method for custom making a hairpiece that is constructed from the user's own hair.

Concern over personal appearance is a virtually universal trait of humans, with the style and appearance of hair being an especially important aspect of this concern. Artificial hair pieces have, accordingly, become extremely popular not only to aid those interested in the ability to change the appearance of their hair, but also to serve as a substitute for hair which may have been lost due to baldness.

Often the hair piece includes a comb component that engages with the user's natural hair and holds the hair piece in place. For example, U.S. Pat. No. 4,788,991 to Nocera et al. discloses a hair piece that has a fabric body which is attached to a comb. However, the comb is usually not very effective in firmly holding the hair piece in place because the comb does not generate any holding or engaging force on its own and instead relies on the presence of a significant amount of natural hair to engage with the bristles of the comb for maintaining the hair piece in its proper place. Unfortunately, if there is an insufficient amount of natural hair, which is often the reason for wearing the hair piece, it is impossible to hold the hair piece in place. Thus, there is a need for a hair piece that provides the user an alternative way of affixing the hair piece to his scalp.

To overcome the problems of comb-attached hair pieces, some have suggested hair pieces that use an adhesive paste to affix to the user's scalp. While these hairpieces advantageously attach firmly to the user's head and do not come loose, they generally come pre-assembled from the manufacturers. Often, these hair pieces are made of synthetic hair, which are easy to spot and look funny. Alternately, the hair pieces may be constructed from hair extracted from other human beings, but such hair pieces are generally very expensive.

The use of the existing hairpieces is further disadvantageous in that the user is required to further adjust his existing hairline to blend and match the hair texture and color of the hair piece with his existing hairline. Such adjustment of the existing hairline may even include coloring or trimming one's existing hair.

While these units mentioned above may be suitable for the particular purpose employed, or for general use, they would not be as suitable for the purposes of the present invention as disclosed hereafter.

SUMMARY OF THE INVENTION

To overcome the above-mentioned disadvantages of the prior art hair pieces, it is an object of the present invention to provide a hair piece that allows the user to construct a hair piece from his own existing hair or from the hair of someone personally known to the user.

It is another object of the present invention to provide a "do it yourself" hair piece kit that is easy and inexpensive to use.

It is yet another object of the present invention to provide a hair piece kit that allows the user to firmly attach the hair piece to his scalp.

It is a further object of the present invention to provide a hair piece kit that is easy to adjust to user's existing hairline.

To accomplish these and other related objects, the present invention may be embodied in the forms illustrated in the enclosed drawings. It is to be noted that the scope of the present invention is not limited by this description or the enclosed drawings, and may include other embodiments obvious to those skilled in the art of the present invention.

BRIEF DESCRIPTION OF THE DRAWINGS

For a better understanding of the above and other features of the present invention, reference should be made to the following detailed description of the preferred embodiments illustrated in the accompanying drawings, wherein.

DETAILED DESCRIPTION OF THE PREFERRED EMBODIMENTS

Figure 6:
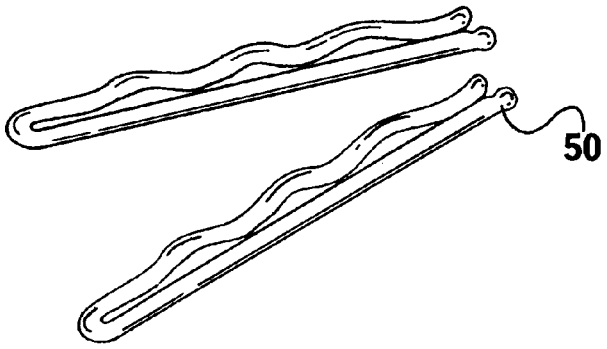
FIG. 6 is a front elevational view of mesh clip.
Figure 7:
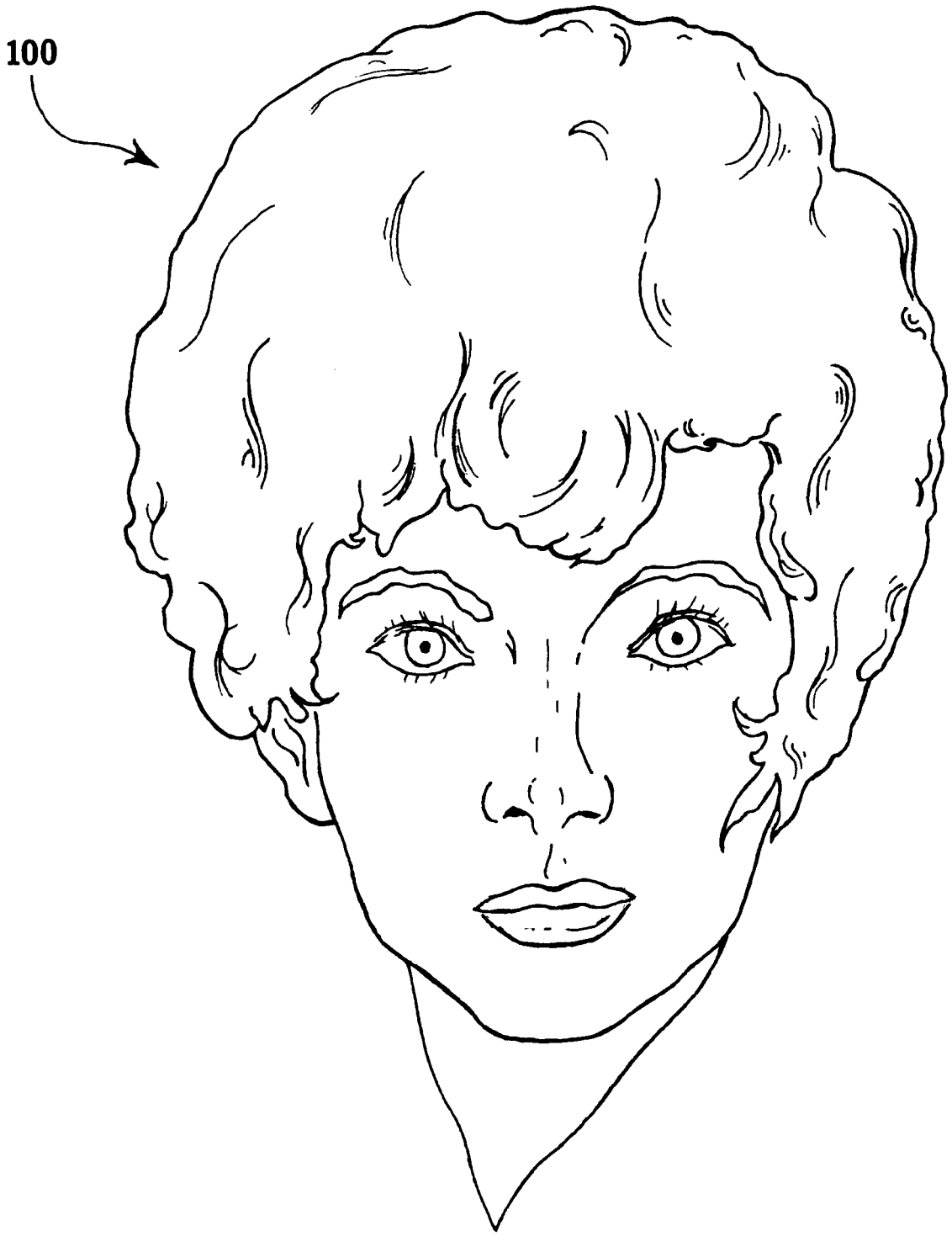
FIG. 7 is a front elevational view of a hair piece made according to the present invention.

FIGS. 1–7 relate to a method for making a hair piece 100, shown in FIG. 7, from a hair piece manufacturing kit by using his own hair or hair from an acquaintance. The hair piece manufacturing kit is provided with a mesh base 10, a gluing gel 30, a two-way tape 40 and hair clips 50.

Figure 1:
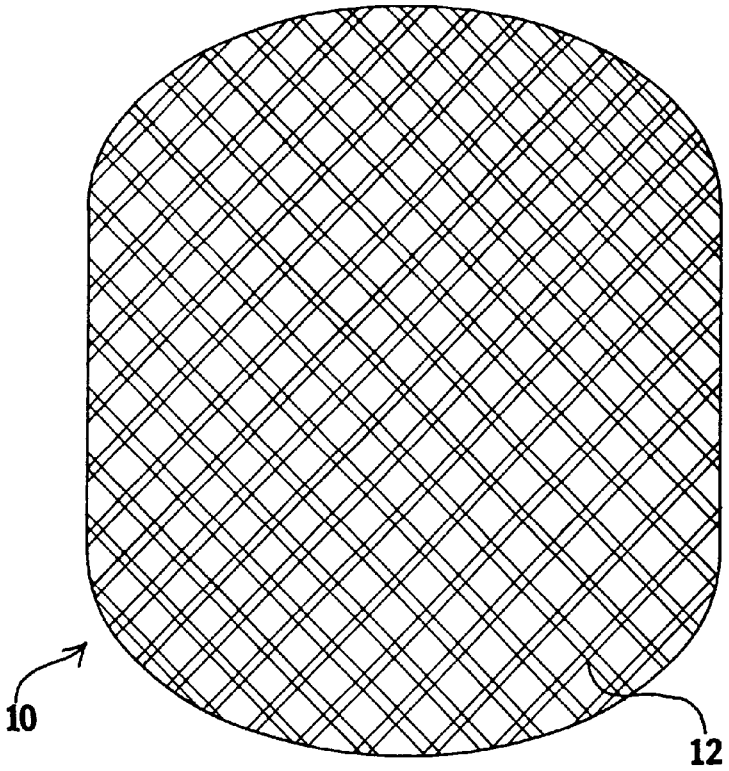
FIG. 1 is a top plan view of a hair mesh.
Figure 2:
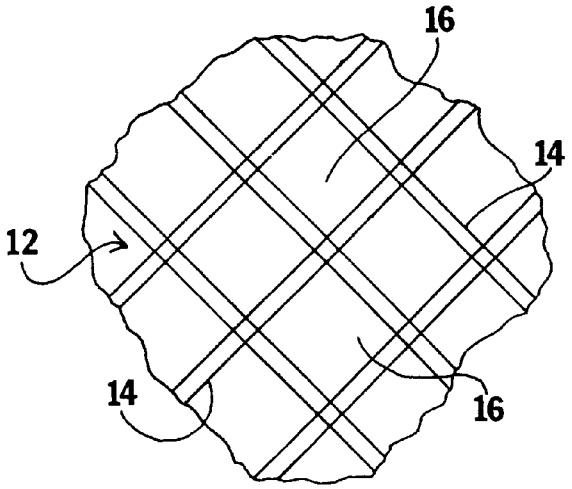
FIG. 2 is a top plan view of an enlarged segment of the hair mesh.

FIG. 1 shows a top view of a mesh base 10 for use with the present invention. The mesh base 10 comprises an elastic body 12. Referring momentarily to FIG. 2, the elastic body 12 is formed from an elastic thread 14, which is knit into a net comprising a plurality of interconnecting loops 16. Other ways of forming an elastic net may be employed, such as by weaving or the like.

The mesh base 10 may be shaped to conform to that of a human head. Alternately, it is possible to construct the mesh base 10 without conforming to the shape of a human head, since the elastic body 12 has multi-directional stretchability that allows the mesh base 10 to easily conform to the wearer's head.

Figure 3:
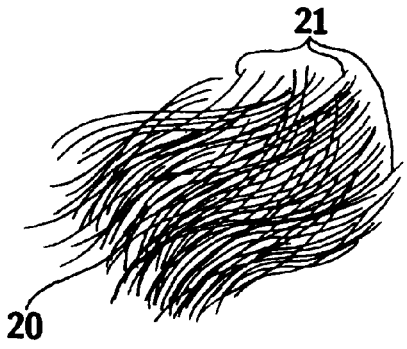
FIG. 3 is a top plan view of a plurality of hair strands.

As shown in FIG. 3, the user must collect strands of hair 20 for use in the hair piece 100. The amount of hair strands 20 needed is dependent on the size of the hair piece 100 to be used. The user may himself be the source for hair strands 20 by trimming his existing natural hair, or, alternately, the user may obtain hair strands 20 from an acquaintance or a relative.

Once a satisfactory amount of hair strands 20 have been collected, the user is ready to construct his hair piece 100. Each hair strand 20 has a base end 21 which is the end from where the hair strand 20 was cut.

Figure 4:
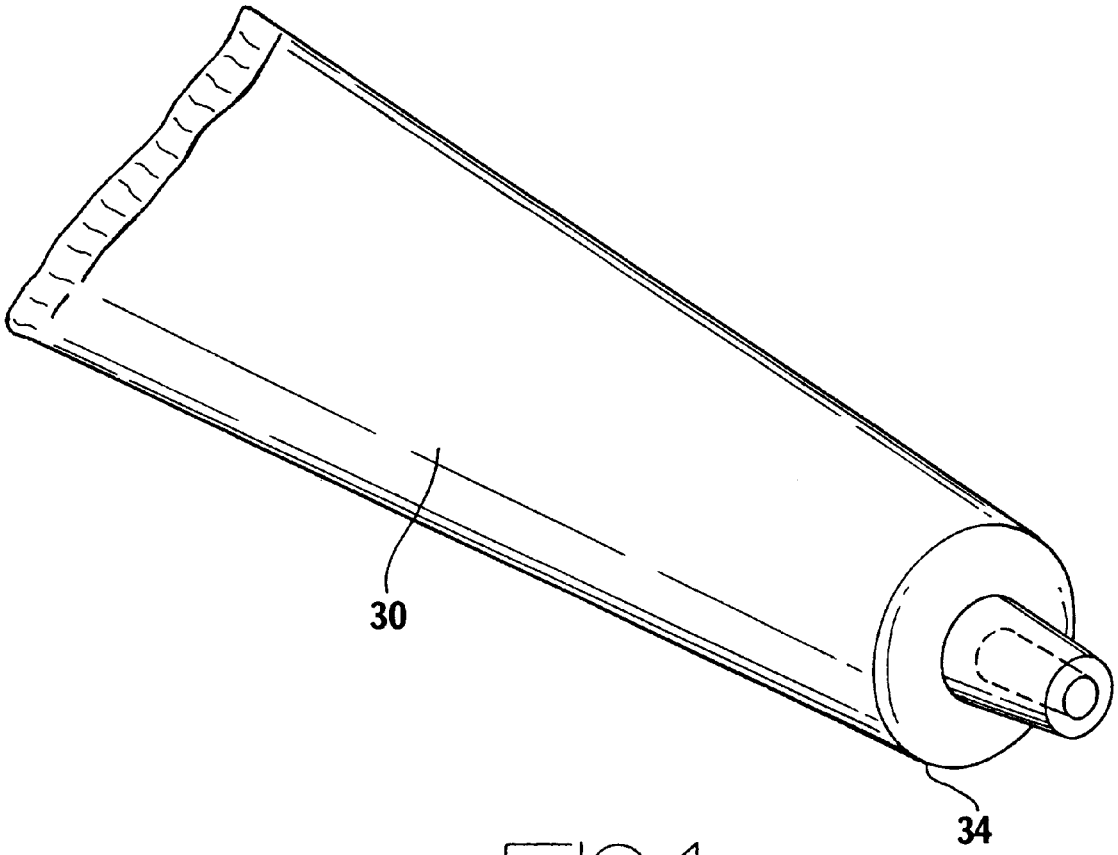
FIG. 4 is a front elevational view of a tube of glue.
Figure 5:
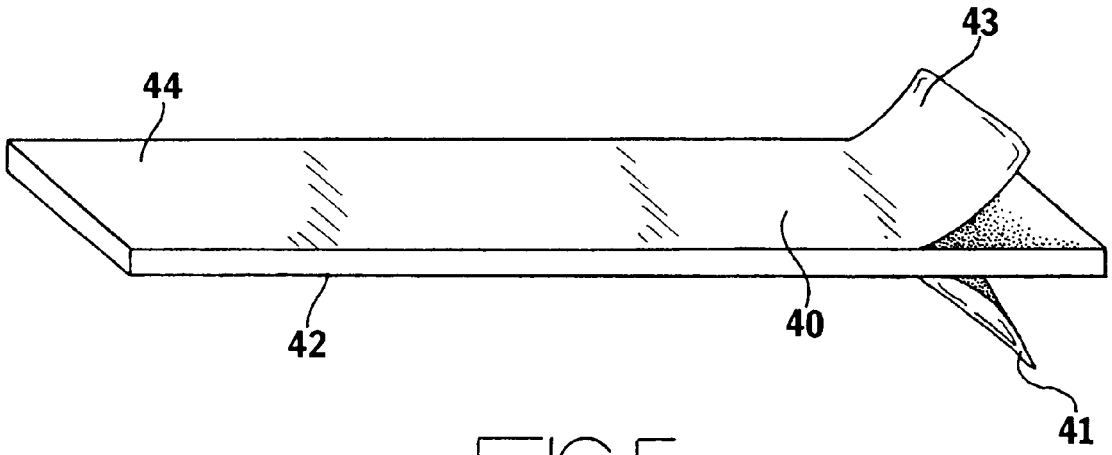
FIG. 5 is a front elevational view of a two way tape.

The user lightly coats the base end 21 of each strand of hair 20 with a gluing gel 30, shown in FIG. 4. The glue-coated base end 21 of the hair strand is inserted into the loop 16. Applying the gluing gel 30 to hair 20 before insertion into loop 16 ensures that the hair strands 20 are firmly stuck in the mesh base 10. As shown in FIG. 4, the gluing gel 30 comes in a tubular body 34.

Generally, only one hair strand 20 is inserted into each loop 16. However, the elasticity of the thread 14 makes it possible to insert a plurality of hair strands 20 into each loop 16, which provides the user with a denser hair piece.

According to the present invention, a two-way tape 40 is provided having a top adhesive surface 44 covered by a top non-stick paper 43 and bottom adhesive surface 42 covered by a bottom non-stick paper 41. Once every loop 16 of the mesh base 10 has been provided with hair strands 20, the mesh base 10 is secured on the top adhesive surface 44 of the two-way adhesive tape 40, shown in FIG. 5, by removing the top non-stick paper 43.

After the mesh base 10 has been securely attached to the two-way adhesive tape 40, the user may cut the hair piece 100 into a shape that matches the surface area over which the hair piece 100 is to be applied.

Once the hair piece 100 has been appropriately shaped, the hair piece 100 is applied by removing the bottom non-stick paper 41 and adhering the bottom adhesive surface 44 of the two-way tape 40 to the user's scalp.

For users who do not wish to adhere the hair piece 100 to their scalp, it is possible to utilize the hair clips 50 shown in FIG. 6. According to this embodiment, the user clips on the hair clips 50 to the hair piece 100 and then attaches the hair piece to his existing natural hair by clipping the hair clips 50 to his existing natural hair.

It is also possible to attach the hair piece 100 to the user's scalp by adhering the bottom adhesive surface 44 onto one's scalp, along with attaching the hair clips 60 to the existing natural hair. The hair clips 50 are provided in colors that resemble the users' to ensure that the hair clips 50 blend in with the users' existing natural hair Many specific details contained in the above description merely illustrate some preferred embodiments and should not be construed as a limitation on the scope of the invention. Accordingly, many other variations are possible within the true spirit of the present invention, limited only by the scope of the claims that follow.

I claim:

1. A method for constructing a hair piece for a balding person from a hair piece manufacturing kit comprising a mesh base with a plurality of loops, a two-way tape having a top adhesive surface and a bottom adhesive surface, a gluing gel and a hair clip, comprising the steps of:

(a) collecting a plurality of hair strands, said hair strands having a base end;

(b) gently coating said base ends with the gluing gel;

(c) inserting the base end of said hair strands into the loops on the mesh base; and (d) securely attaching the mesh base to the top adhesive surface of said two-way tape.

2. The method of claim 1, wherein said plurality of hair strands are collected by trimming the balding person's existing hair.

3. The method of claim 1, further comprising the step of attaching said hair piece with a pair of hair clips to the balding person's head.

4. The method of claim 1, further comprising the step of cutting said hair piece into a desired shape after said step (d).

5. The method of claim 4, further comprising the step of attaching said hair piece with a pair of hair clips to the balding person's head.

* * * * *